US011401596B2

(12) United States Patent
Nakano

(10) Patent No.: US 11,401,596 B2
(45) Date of Patent: Aug. 2, 2022

(54) AMORPHOUS ALLOY PARTICLE AND METHOD FOR MANUFACTURING AMORPHOUS ALLOY PARTICLE

(71) Applicant: Murata Manufacturing Co., Ltd., Kyoto-fu (JP)

(72) Inventor: Manabu Nakano, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 16/903,241

(22) Filed: Jun. 16, 2020

(65) Prior Publication Data

US 2020/0308680 A1 Oct. 1, 2020

Related U.S. Application Data

(63) Continuation of application No. PCT/JP2018/045940, filed on Dec. 13, 2018.

(30) Foreign Application Priority Data

Dec. 19, 2017 (JP) ..... JP2017-242692

(51) Int. Cl.

| | |
|---|---|
| ***C22C 45/02*** | (2006.01) |
| ***C21D 7/04*** | (2006.01) |
| ***C22C 33/00*** | (2006.01) |
| ***C22C 38/02*** | (2006.01) |

(52) U.S. Cl.

CPC ..... *C22C 45/02* (2013.01); *C21D 7/04* (2013.01); *C22C 33/003* (2013.01); *C22C 38/02* (2013.01); *C21D 2201/03* (2013.01); *C21D 2261/00* (2013.01); *C22C 2200/02* (2013.01)

(58) Field of Classification Search

CPC ..... C22C 45/02; C22C 33/003; C22C 38/02; C22C 2200/02; C21D 7/04; C21D 2201/03; C21D 2261/00

See application file for complete search history.

(56) References Cited

U.S. PATENT DOCUMENTS

2016/0336104 A1 11/2016 Noguchi et al.
2018/0043431 A1* 2/2018 Araki ..... B22F 9/02

FOREIGN PATENT DOCUMENTS

| | | | | |
|---|---|---|---|---|
| CN | 101145420 | A | | 3/2008 |
| CN | 105917422 | A | | 8/2016 |
| JP | S59-166606 | A | | 9/1984 |
| JP | S63-223106 | A | | 9/1988 |
| JP | 2004-111540 | A | | 4/2004 |
| JP | 2007-077488 | A | | 3/2007 |
| JP | 2007077488 | A | * | 3/2007 |
| JP | 2013-067863 | A | | 4/2013 |
| JP | 2013-138159 | A | | 7/2013 |
| JP | 2013-165251 | A | | 8/2013 |

(Continued)

OTHER PUBLICATIONS

JP2007077488A translation (Year: 2021).*

(Continued)

*Primary Examiner* — Robert S Jones, Jr.
*Assistant Examiner* — Jiangtian Xu
(74) *Attorney, Agent, or Firm* — Studebaker & Brackett PC

(57) ABSTRACT

An amorphous alloy particle is an amorphous alloy particle formed of an iron-based alloy, and the particle contains a grain boundary layer.

6 Claims, 1 Drawing Sheet

(56) References Cited

FOREIGN PATENT DOCUMENTS

| | | | |
|---|---|---|---|
| JP | 2014-060183 | A | 4/2014 |
| JP | 2016-060956 | A | 4/2016 |
| JP | 2016180154 | * | 10/2016 |

OTHER PUBLICATIONS

International Search Report issued in PCT/JP2018/045940; dated Feb. 26, 2019.
International Preliminary Report On Patentability and Written Opinion issued in PCT/JP2018/045940; dated Jun. 23, 2020.
An Office Action; "Decision of Refusal," mailed by the Japanese Patent Office dated Sep. 28, 2021, which corresponds to Japanese Patent Application No. 2019-561027 and is related to U.S. Appl. No. 16/903,241 with English translation.

* cited by examiner

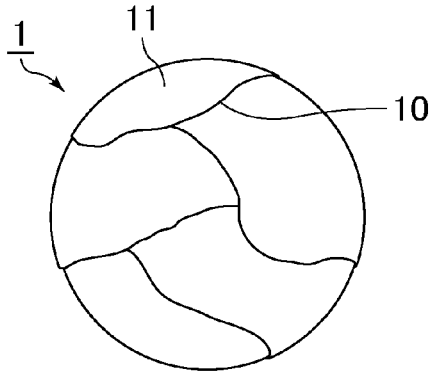
1
11
10

AMORPHOUS ALLOY PARTICLE AND METHOD FOR MANUFACTURING AMORPHOUS ALLOY PARTICLE

CROSS-REFERENCE TO RELATED APPLICATIONS

This application claims benefit of priority to International Patent Application No. PCT/JP2018/045940, filed Dec. 13, 2018, and to Japanese Patent Application No. 2017-242692, filed Dec. 19, 2017, the entire contents of each are incorporated herein by reference

BACKGROUND

Technical Field

The present disclosure relates to an amorphous alloy particle and a method for manufacturing an amorphous alloy particle.

Background Art

Iron, silicon steel, and the like have been used as soft magnetic materials for use in, for example, various reactors, motors, and transformers. These have a high magnetic flux density, but have a large hysteresis due to high magnetocrystalline anisotropy. Thus, magnetic components formed of these materials have a problem of increased loss.

In response to such a problem, Japanese Unexamined Patent Application Publication No. 2013-67863 discloses a soft magnetic alloy powder represented by the composition formula: $Fe_{100-x-y}Cu_xB_y$ (where $1<x<2$, $10\leq y\leq 20$ by atomic %) and having a structure in which body-centered cubic crystal grains that have an average particle diameter of 60 nm or less are dispersed in a volume fraction of 30% or more in an amorphous matrix.

SUMMARY

Japanese Unexamined Patent Application Publication No. 2013-67863 discloses that the disclosure therein has an effect of providing a high saturated magnetic flux density and good soft magnetic characteristics. However, the disclosure in Japanese Unexamined Patent Application Publication No. 2013-67863 has a problem of insufficient high-frequency characteristics.

Accordingly, the present disclosure provides an amorphous alloy particle capable of providing favorable high-frequency characteristics. The present disclosure also provides a method for manufacturing the amorphous alloy particle.

An amorphous alloy particle according to the present disclosure is an amorphous alloy particle formed of an iron-based alloy, the particle containing a grain boundary layer.

In the amorphous alloy particle according to the present disclosure, the grain boundary layer may have a thickness of 200 nm or less.

In the amorphous alloy particle according to the present disclosure, the iron-based alloy may contain Fe, Si, and B.

A method for manufacturing an amorphous alloy particle according to the present disclosure includes subjecting an amorphous material formed of an iron-based alloy to shear processing to thereby plastically deform the material into particles and to introduce a grain boundary layer into the particles.

In the method for manufacturing an amorphous alloy particle according to the present disclosure, the shear processing is performed by using a high-speed rotary mill, and a rotor of the high-speed rotary mill may have a circumferential speed of 40 m/s or more.

In the method for manufacturing an amorphous alloy particle according to the present disclosure, the shear processing may be performed on an amorphous alloy thin strip formed of an iron-based alloy.

With the present disclosure, an amorphous alloy particle capable of providing favorable high-frequency characteristics can be provided.

BRIEF DESCRIPTION OF THE DRAWING

The FIGURE is a partial sectional view schematically illustrating an example of an amorphous alloy particle according to the present disclosure.

DETAILED DESCRIPTION

Hereafter, an amorphous alloy particle according to the present disclosure will be described. However, the present disclosure is not limited to the structures below and may be applied with appropriate modification within the scope that does not depart from the spirit of the present disclosure. The present disclosure also includes a combination of two or more desirable structures of the present disclosure described below.

[Amorphous Alloy Particle]

The FIGURE is a partial sectional view schematically illustrating an example of an amorphous alloy particle according to the present disclosure.

An amorphous alloy particle 1 of the FIGURE is an amorphous alloy particle formed of an iron-based alloy, with one particle containing a plurality of grain boundary layers 10. That is, the amorphous alloy particle 1 of the FIGURE is one particle made of a plurality of primary particles 11.

In the amorphous alloy particle according to the present disclosure, high-frequency characteristics can be improved by introducing a grain boundary layer into the particle.

A conceivable reason is as follows.

The core loss Pcv, which is the loss of a coil or an inductor, is represented by Formula (1) below.

$$Pcv=Phv+Pev=Wh\cdot f+A\cdot f^2\cdot d^2/\rho \quad (1)$$

Pcv: Core loss ($kW/m^3$)
Phv: Hysteresis loss ($kW/m^3$)
Pev: Eddy current loss ($kW/m^3$)
f: Frequency (Hz)
Wh: Hysteresis loss coefficient ($kW/m^3\cdot Hz$)
d: Particle diameter (m)
ρ: Intragranular electrical resistivity (Ω·m)
A: Coefficient The loss at high frequencies is dominated by eddy current loss Pev, which increases with the square of the frequency. Thus, Pev needs to be decreased to improve high-frequency characteristics. From Formula (1) above, Pev is affected by frequency, particle diameter, and intragranular electrical resistivity. In the present disclosure, because the intragranular electrical resistivity can be increased by introducing a grain boundary layer into the particle, Pev can be decreased. As a result, improved high-frequency characteristics are expected.

The amorphous alloy particle according to the present disclosure is a soft magnetic particle and is an amorphous alloy particle formed of an iron-based alloy. In the amorphous alloy particle according to the present disclosure, the composition of the iron-based alloy is not particularly limited, but the iron-based alloy preferably contains Fe, Si, and B in view of forming the alloy into amorphous alloy particles. Examples of the preferable composition of the iron-based alloy include FeSiB, FeSiBNbCu, and FeSiBC.

The amorphous alloy particle according to the present disclosure is one particle containing at least one grain boundary layer. The presence of a grain boundary layer in a particle can be confirmed, for example, by the distinct contrast of the portion corresponding to the primary particle surrounded by the grain boundary layer when a section of the particle is observed with, for example, a scanning electron microscope (SEM).

The grain boundary layer of the amorphous alloy particle according to the present disclosure is a layer formed of an oxide of a metal element contained in the iron-based alloy and elemental oxygen. Thus, the thickness of the grain boundary layer can be measured by performing elemental mapping of oxygen in the section of the particle.

In the amorphous alloy particle according to the present disclosure, while the intragranular electrical resistivity can be increased by thickening the grain boundary layer, the saturated magnetic flux density deteriorates when the grain boundary layer is thickened. This is because the volume proportion of a non-magnetic oxide or an oxide having a low saturated magnetic flux density is increased. Thus, in view of balancing high-frequency characteristics and saturated magnetic flux density, the thickness of the grain boundary layer is preferably 200 nm or less, more preferably 50 nm or less. Furthermore, the thickness of the grain boundary layer is preferably 1 nm or more, more preferably 10 nm or more.

Here "thickness of the grain boundary layer" refers to the average thickness of the grain boundary layer in a field of view, when the field of view is defined in a range of 1 μm×1 μm and sectional observation is performed and the thickness of the grain boundary layer is measured at 10 locations or more through a line segment method.

The average particle diameter of the amorphous alloy particle according to the present disclosure is not particularly limited, but, for example, is preferably 0.1 μm or more and preferably 1 μm or less (i.e., from 0.1 μm to 1 μm). Here "average particle diameter" refers to the average particle diameter of the circle equivalent diameter of each particle present in a field of view, when the field of view is defined in a range of 1 μm×1 μm and sectional observation is performed and the particle diameter of each particle is measured at 10 locations or more through a line segment method.

[Method for Manufacturing Amorphous Alloy Particle]

The method for manufacturing an amorphous alloy particle according to the present disclosure includes subjecting an amorphous material formed of an iron-based alloy to shear processing to thereby plastically deform the material into particles and to introduce a grain boundary layer into the particles.

In the method for manufacturing an amorphous alloy particle according to the present disclosure, the form of the amorphous material formed of an iron-based alloy is not particularly limited and may be in the form of, for example, a thin strip, a fiber, or a thick plate. Among these, shear processing is preferably performed on an amorphous alloy thin strip formed of an iron-based alloy in the method for manufacturing an amorphous alloy particle according to the present disclosure.

To obtain the alloy thin strip as a long ribbon-like thin strip, an Fe-containing alloy is melted into an alloy melt by way of, for example, arc melting or high-frequency induction melting, and the alloy melt is quenched. As the method for quenching the alloy melt, for example, a single-roll quenching method is used.

In the method for manufacturing an amorphous alloy particle according to the present disclosure, the composition of the iron-based alloy is not particularly limited, but the iron-based alloy preferably contains Fe, Si, and B in view of forming the alloy into amorphous alloy particles. Examples of the preferable composition of the iron-based alloy include FeSiB, FeSiBNbCu, and FeSiBC.

In the method for manufacturing an amorphous alloy particle according to the present disclosure, shear processing is preferably performed by using a high-speed rotary mill. A high-speed rotary mill is an apparatus where, for example, a hammer, a blade, or a pin is rotated at a high speed to thereby perform milling through shearing. The high-speed rotary mill is, for example, a hammer mill or a pin mill. The high-speed rotary mill preferably includes a mechanism that circulates particles.

In shear processing using a high-speed rotary mill, plastic deformation or hybridization is performed in addition to milling of particles, and as a result, a grain boundary layer can be introduced into the particles.

The rotor of the high-speed rotary mill preferably has a circumferential speed of 40 m/s or more in view of sufficiently introducing a grain boundary layer into the particles. The circumferential speed is, for example, preferably 150 m/s or less, more preferably 120 m/s or less.

In the method for manufacturing an amorphous alloy particle according to the present disclosure, before shear processing, heat treatment may be performed on the amorphous material formed of an iron-based alloy. The thickness of the grain boundary layer can be changed by changing heat treatment conditions.

The heat treatment may be performed on amorphous alloy particles obtained after shear processing. Furthermore, the thickness of the grain boundary layer can be changed by changing the temperature at which shear processing is performed.

In the method for manufacturing an amorphous alloy particle according to the present disclosure, the thickness of the grain boundary layer is increased as the temperature for heat treatment is increased. The temperature for heat treatment is not particularly limited, but, for example, is preferably 80° C. or more and preferably 600° C. or less (i.e., from 80° C. to 600° C.).

EXAMPLES

Hereafter, Examples that more specifically disclose the amorphous alloy particle according to the present disclosure will be provided. These examples are not intended to limit the present disclosure.

[Production of Alloy Particles]

Example 1-1

An alloy thin strip having a composition of FeSiB produced through a single-roll quenching method was prepared as a raw material. This alloy thin strip was milled by using a high-speed rotary mill to produce alloy particles.

A Hybridization System (type NHS-0, manufactured by Nara Machinery Co., Ltd.) was used as the high-speed rotary mill.

In Table 1, the processing time (the rotation time of the rotor) and the circumferential speed (the rotation speed of the rotor) are presented.

Examples 1-2 to 1-8

The same processing was performed as in Example 1-1 to produce alloy particles except that the processing time and the circumferential speed were changed to the values presented in Table 1.

Comparative Examples 1-1 to 1-4

The same processing was performed as in Example 1-1 to produce alloy particles except that the processing time and the circumferential speed were changed to the values presented in Table 1.

Comparative Example 1-5

The same processing was performed as in Example 1-1 to produce alloy particles except that milling was performed by using a high-speed impact mill in place of the high-speed rotary mill and that the processing time was changed to the value presented in Table 1. A Jet Mill (type AS-100, manufactured by Hosokawa Micron Corporation) was used as the high-speed impact mill.

Comparative Examples 1-6 to 1-8

The same processing was performed as in Comparative Example 1-5 to produce alloy particles except that the processing time was changed to the values presented in Table 1.

[Crystallinity of Alloy Particles]

The crystallinity of the alloy particles produced in Examples 1-1 to 1-8 and Comparative Examples 1-1 to 1-8 was confirmed from X-ray diffraction patterns. As a result, all the alloy particles were confirmed to be amorphous.

[Presence or Absence of Grain Boundary Layer]

The alloy particles produced in Examples 1-1 to 1-8 and Comparative Examples 1-1 to 1-8 were dispersed in a silicone resin, heat-cured, and then subjected to sectional polishing. SEM observation of sections of the resulting alloy particles was performed to thereby confirm the presence or absence of a grain boundary layer in the particles. The presence or absence of a grain boundary layer is presented in Table 1.

[Intragranular Electrical Resistivity]

The intragranular electrical resistivity of the sections of the resulting alloy particles was measured through a four-terminal method. The results are presented in Table 1.

[Eddy Current Loss]

The eddy current loss was calculated from the measured intragranular electrical resistivity. Pcv was measured on the basis of Formula (1) above, and Phv and Pev were calculated on the basis of the same formula. The following measurement conditions were used: Bm=40 mT, f=0.1 to 1 MHz. A B-H Analyzer SY8218 manufactured by Iwatsu Electric Co., Ltd. was used as the measuring machine. The results are presented in Table 1.

TABLE 1

| | Raw material | Mill | Processing time (s) | Circumferential speed (m/s) | Grain boundary layer | Intragranular electrical resistivity (μΩ · cm) | Eddy current loss 40 mT-1 MHz (kW/m$^3$) |
|---|---|---|---|---|---|---|---|
| Example 1-1 | FeSiB thin strip | High-speed rotary | 180 | 40 | Present | 120 | 3984 |
| Example 1-2 | FeSiB thin strip | High-speed rotary | 300 | 40 | Present | 150 | 3175 |
| Example 1-3 | FeSiB thin strip | High-speed rotary | 600 | 40 | Present | 180 | 2444 |
| Example 1-4 | FeSiB thin strip | High-speed rotary | 900 | 40 | Present | 200 | 2103 |
| Example 1-5 | FeSiB thin strip | High-speed rotary | 1800 | 40 | Present | 220 | 1966 |
| Example 1-6 | FeSiB thin strip | High-speed rotary | 60 | 80 | Present | 150 | 3913 |
| Example 1-7 | FeSiB thin strip | High-speed rotary | 180 | 80 | Present | 220 | 2668 |
| Example 1-8 | FeSiB thin strip | High-speed rotary | 300 | 30 | Present | 115 | 4088 |
| Comparative Example 1-1 | FeSiB thin strip | High-speed rotary | 5 | 40 | Absent | 100 | 5231 |
| Comparative Example 1-2 | FeSiB thin strip | High-speed rotary | 30 | 40 | Absent | 100 | 4962 |
| Comparative Example 1-3 | FeSiB thin strip | High-speed rotary | 60 | 40 | Absent | 100 | 4785 |
| Comparative Example 1-4 | FeSiB thin strip | High-speed rotary | 30 | 80 | Absent | 100 | 4278 |
| Comparative Example 1-5 | FeSiB thin strip | High-speed impact | 60 | — | Absent | 100 | 5391 |
| Comparative Example 1-6 | FeSiB thin strip | High-speed impact | 180 | — | Absent | 100 | 4983 |
| Comparative Example 1-7 | FeSiB thin strip | High-speed impact | 600 | — | Absent | 100 | 4931 |
| Comparative Example 1-8 | FeSiB thin strip | High-speed impact | 1800 | — | Absent | 100 | 4400 |

In Examples 1-1 to 1-8, a grain boundary layer is introduced into the particles by milling using the high-speed rotary mill. As a result, the intragranular electrical resistivity is increased and the eddy current loss decreases, which leads to an effect of improving high-frequency characteristics.

On the other hand, in Comparative Examples 1-1 to 1-8, no grain boundary layer is introduced into the particles, which leads to no effect of improving high-frequency characteristics. Even when the high-speed rotary mill is used, in the case where the processing time is short, as in Comparative Examples 1-1 to 1-4, no grain boundary layer is expected to be introduced into the particles. Furthermore, when the high-speed impact mill is used, as in Comparative Examples 1-5 to 1-8, it is expected that no grain boundary layer can be introduced into the particles despite the occurrence of milling as a result of chipping.

Production of Alloy Particles

Example 2-1

As in Example 1-1, an alloy thin strip having a composition of FeSiB produced through a single-roll quenching method was prepared as a raw material. After heat treatment was performed on the alloy thin strip under the conditions presented in Table 2, the same processing was performed as in Example 1-1 to produce alloy particles.

Examples 2-2 to 2-8

The same processing was performed as in Example 2-1 to produce alloy particles except that the heat treatment conditions were changed to the values presented in Table 2.

Comparative Example 2-1

The same processing was performed as in Comparative Example 1-1 to produce alloy particles except that no heat treatment was performed on the alloy thin strip.

[Crystallinity of Alloy Particles]

The crystallinity of the alloy particles produced in Examples 2-1 to 2-8 and Comparative Example 2-1 was confirmed from X-ray diffraction patterns. As a result, all the alloy particles were confirmed to be amorphous.

[Thickness of Grain Boundary Layer]

The alloy particles produced in Examples 2-1 to 2-8 and Comparative Example 2-1 were dispersed in a silicone resin, heat-cured, and then subjected to sectional polishing.

SEM observation of sections of the resulting alloy particles and elemental mapping of oxygen in the sections were performed to thereby measure the thickness of the grain boundary layer. The results are presented in Table 2.

[Saturated Magnetic Flux Density]

The saturated magnetic flux density of the alloy particles produced in Examples 2-1 to 2-8 and Comparative Example 2-1 was measured by using a vibrating-sample magnetometer (VSM apparatus). The results are presented in Table 2.

[Intragranular Electrical Resistivity]

The intragranular electrical resistivity of the alloy particles produced in Example 2-1 to 2-8 and Comparative Example 2-1 was measured through the same method as in, for example, Example 1-1. The results are presented in Table 2.

TABLE 2

| | Raw material | Mill | Heat treatment temperature (° C.) | Heat treatment time (s) | Grain boundary layer thickness (nm) | Saturated magnetic flux density (T) | Intragranular electrical resistivity (μΩ · cm) |
|---|---|---|---|---|---|---|---|
| Example 2-1 | FeSiB thin strip | High-speed rotary | 100 | 10 | 1 | 1.40 | 110 |
| Example 2-2 | FeSiB thin strip | High-speed rotary | 200 | 30 | 5 | 1.40 | 120 |
| Example 2-3 | FeSiB thin strip | High-speed rotary | 200 | 60 | 10 | 1.40 | 120 |
| Example 2-4 | FeSiB thin strip | High-speed rotary | 200 | 600 | 50 | 1.39 | 150 |
| Example 2-5 | FeSiB thin strip | High-speed rotary | 250 | 600 | 100 | 1.36 | 200 |
| Example 2-6 | FeSiB thin strip | High-speed rotary | 300 | 600 | 200 | 1.33 | 280 |
| Example 2-7 | FeSiB thin strip | High-speed rotary | 350 | 600 | 300 | 1.21 | 400 |
| Example 2-8 | FeSiB thin strip | High-speed rotary | 425 | 600 | 500 | 1.07 | 550 |
| Comparative Example 2-1 | FeSiB thin strip | High-speed rotary | None | None | 0 | 1.40 | 100 |

The thickness of a surface oxide layer can be changed by changing the heat treatment conditions for the alloy thin strip. Specifically, the thickness of the oxide layer is increased as the heat treatment temperature is increased and the heat treatment time is lengthened. Because the thickness of the grain boundary layer corresponds to the thickness of the oxide layer, the thickness of the grain boundary layer can be changed by changing the heat treatment conditions for the alloy strip as presented in Example 2.

According to the results of Examples 2-1 to 2-8 and Comparative Example 2-1, while the intragranular electrical resistivity can be increased by thickening the grain boundary layer, the saturated magnetic flux density deteriorates when the grain boundary layer is thickened. According to Table 2, high intragranular electrical resistivity and a high saturated magnetic flux density can be achieved when the grain boundary layer has a thickness of 200 nm or less.

Production of Alloy Particles

Examples 3-1 to 3-3

An alloy thin strip having a composition of FeSiB produced through a single-roll quenching method was prepared as a raw material, and the same processing was performed as in Example 1-1 under the conditions presented in Table 3 to produce alloy particles.

Examples 3-4 to 3-6

An alloy thin strip having a composition of FeSiBNbCu produced through a single-roll quenching method was prepared as a raw material, and the same processing was performed as in Example 1-1 under the conditions presented in Table 3 to produce alloy particles.

Comparative Examples 3-1 to 3-3

An alloy thin strip having a composition of FeSi produced through a single-roll quenching method was prepared as a raw material, and the same processing was performed as in Example 1-1 under the conditions presented in Table 3 to produce alloy particles.

Comparative Examples 3-4 to 3-6

A metal thin strip having a composition of Fe produced through a single-roll quenching method was prepared as a raw material, and the same processing was performed as in Example 1-1 under the conditions presented in Table 3 to produce metal particles.

[Crystallinity of Alloy Particles]

The crystallinity of the alloy particles produced in Examples 3-1 to 3-6 and Comparative Examples 3-1 to 3-3 and the metal particles produced in Comparative Example 3-4 to 3-6 was confirmed from X-ray diffraction patterns. As a result, the alloy particles produced in Examples 3-1 to 3-6 were confirmed to be amorphous, while the alloy particles produced in Comparative Examples 3-1 to 3-3 and the metal particles produced in Comparative Examples 3-4 to 3-6 were confirmed to be crystalline.

[Presence or Absence of Grain Boundary Layer]

The presence or absence of a grain boundary layer in the alloy particles produced in Examples 3-1 to 3-6 and Comparative Examples 3-1 to 3-3 and in the metal particles produced in Comparative Examples 3-4 to 3-6 was confirmed through the same method as in, for example, Example 1-1. The presence or absence of a grain boundary layer is presented in Table 3.

[Intragranular Electrical Resistivity]

The intragranular electrical resistivity of the alloy particles produced in Examples 3-1 to 3-6 and Comparative Examples 3-1 to 3-3 and the metal particles produced in Comparative Examples 3-4 to 3-6 was measured through the same method as in, for example, Example 1-1. The results are presented in Table 3.

[Eddy Current Loss]

The eddy current loss was calculated from the measured intragranular electrical resistivity. Pcv was measured on the basis of Formula (1) above, and Phv and Pev were calculated on the basis of the same formula. The following measurement conditions were used: Bm=40 mT, f=0.1 to 1 MHz. A B-H Analyzer SY8218 manufactured by Iwatsu Electric Co., Ltd. was used as the measuring machine. The results are presented in Table 3.

TABLE 3

| | Composition | Mill | Processing time (s) | Circumferential speed (m/s) | Grain boundary layer | Intragranular electrical resistivity (μΩ · cm) | Eddy current loss 40 mT-1 MHz (kW/m$^3$) | Crystallinity |
|---|---|---|---|---|---|---|---|---|
| Example 3-1 | FeSiB | High-speed rotary | 180 | 40 | Present | 120 | 3984 | Amorphous |
| Example 3-2 | FeSiB | High-speed rotary | 300 | 40 | Present | 150 | 3175 | Amorphous |
| Example 3-3 | FeSiB | High-speed rotary | 600 | 40 | Present | 180 | 2444 | Amorphous |
| Example 3-4 | FeSiBNbCu | High-speed rotary | 180 | 40 | Present | 130 | 3689 | Amorphous |
| Example 3-5 | FeSiBNbCu | High-speed rotary | 300 | 40 | Present | 160 | 3012 | Amorphous |
| Example 3-6 | FeSiBNbCu | High-speed rotary | 600 | 40 | Present | 180 | 2645 | Amorphous |
| Comparative Example 3-1 | FeSi | High-speed rotary | 5 | 40 | Present | 30 | 5231 | Crystalline |
| Comparative Example 3-2 | FeSi | High-speed rotary | 180 | 40 | Present | 40 | 4962 | Crystalline |
| Comparative Example 3-3 | FeSi | High-speed rotary | 300 | 40 | Present | 60 | 4785 | Crystalline |
| Comparative Example 3-4 | Fe | High-speed rotary | 5 | 40 | Present | 10 | 4278 | Crystalline |
| Comparative Example 3-5 | Fe | High-speed rotary | 180 | 40 | Present | 30 | 5391 | Crystalline |
| Comparative Example 3-6 | Fe | High-speed rotary | 300 | 40 | Present | 50 | 5207 | Crystalline |

According to Table 3, when the iron-based alloy contains Fe, Si, and B, the alloy can be formed into amorphous alloy particles. Furthermore, according to the results of Examples 3-1 to 3-6, the same effects are expected with iron-based alloys containing Fe, Si, and B even if the compositions thereof differ.

On the other hand, the results of Comparative Examples 3-1 to 3-6 reveal that the intragranular electrical resistivity is not increased and the eddy current loss increases when the alloy particles or the metal particles are crystalline.

What is claimed is:

1. An amorphous alloy particle formed of an iron-based alloy, the particle comprising a plurality of primary particles plastically deformed into the amorphous alloy particle, each primary particle having a grain boundary layer surrounding the respective primary particle.

2. The amorphous alloy particle according to claim 1, wherein each grain boundary layer has a thickness of 200 nm or less.

3. The amorphous alloy particle according to claim 1, wherein the iron-based alloy contains Fe, Si, and B.

4. The amorphous alloy particle according to claim 2, wherein the iron-based alloy contains Fe, Si, and B.

5. The amorphous alloy particle according to claim 1, wherein each grain boundary layer is a layer formed of elemental oxygen and an oxide of a metal element contained in the primary particle.

6. The amorphous alloy particle according to claim 1, wherein the amorphous alloy particle has an intragranular electrical resistivity greater than 100 μΩ·m.

* * * * *